US006969327B2

(12) United States Patent
Aoyama et al.

(10) Patent No.: US 6,969,327 B2
(45) Date of Patent: Nov. 29, 2005

(54) GOLF BALL DIMPLE PATTERN WITH OVERLAPPING DIMPLES

(75) Inventors: Steven Aoyama, Marion, MA (US); William E. Morgan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/737,812

(22) Filed: Dec. 18, 2003

(65) Prior Publication Data

US 2005/0137032 A1 Jun. 23, 2005

(51) Int. Cl.[7] ..... A63B 37/12
(52) U.S. Cl. ..... 473/383
(58) Field of Search ..... 473/378–385

(56) References Cited

U.S. PATENT DOCUMENTS

| | | | | | |
|---|---|---|---|---|---|
| 4,729,861 | A | | 3/1988 | Lynch et al. | 264/219 |
| 4,877,252 | A | * | 10/1989 | Shaw | 473/379 |
| 4,936,587 | A | | 6/1990 | Lynch et al. | 473/384 |
| 4,960,282 | A | * | 10/1990 | Shaw | 473/379 |
| 5,080,367 | A | | 1/1992 | Lynch et al. | 476/384 |
| 5,273,287 | A | | 12/1993 | Molitor et al. | 473/384 |
| 5,356,150 | A | * | 10/1994 | Lavallee et al. | 473/383 |
| 5,470,075 | A | | 11/1995 | Nesbitt et al. | 473/377 |
| 5,482,286 | A | | 1/1996 | Molitor et al. | 473/372 |
| 5,503,397 | A | | 4/1996 | Molitor et al. | 473/377 |
| 5,507,493 | A | | 4/1996 | Sullivan et al. | 473/377 |
| 5,569,100 | A | | 10/1996 | Molitor et al. | 473/384 |
| 5,588,924 | A | | 12/1996 | Sullivan et al. | 473/377 |
| 5,682,230 | A | | 10/1997 | Anfinsen et al. | 356/28 |
| 5,688,194 | A | * | 11/1997 | Stiefel et al. | 473/383 |
| 5,766,098 | A | | 6/1998 | Molitor et al. | 473/377 |
| 5,772,532 | A | * | 6/1998 | Stiefel et al. | 473/384 |
| 5,833,554 | A | | 11/1998 | Sullivan et al. | 473/374 |
| 5,842,937 | A | | 12/1998 | Dalton et al. | 473/384 |
| 5,971,871 | A | | 10/1999 | Sullivan et al. | 473/373 |
| 6,102,816 | A | | 8/2000 | Sullivan et al. | 473/374 |
| 6,186,002 | B1 | | 2/2001 | Lieberman et al. | 73/432.1 |
| 6,206,792 | B1 | | 3/2001 | Tavares et al. | 473/378 |
| 6,315,685 | B1 | | 11/2001 | Tavares et al. | 473/378 |

* cited by examiner

*Primary Examiner*—Raeann Gorden
(74) *Attorney, Agent, or Firm*—Swidler Berlin LLP

(57) ABSTRACT

A golf ball product, or other non-streamlined body, having a dimple pattern in which at least some of the dimples overlap at least one adjacent dimple is disclosed. A new parameter called Overlap Saturation (OS) is disclosed. OS is the ratio of the number of overlap instances on a ball to the maximum possible number for an ideal hypothetical ball with the same number of dimples. Overlap instances are tallied by summing the number of overlapping neighbor dimples for every dimple. Golf ball products employing the disclosed dimple patterns have an increase in total yardage compared to an equivalent product without overlapping dimples.

7 Claims, 13 Drawing Sheets

GOLF BALL DIMPLE PATTERN WITH OVERLAPPING DIMPLES

BACKGROUND OF THE INVENTION

1. Field of the Invention

The present invention is directed to a golf ball and, more particularly, to a golf ball having an improved dimple pattern. Still more particularly, the present invention is directed to a golf ball having a dimple pattern in which a large portion of the dimples overlap or intersect most of their neighboring dimples.

2. Description of the Related Art

Soon after the introduction of the smooth surfaced gutta percha golf ball in the mid-nineteenth century, players observed that the balls traveled further as they got older and more gouged up. The players then began to roughen the surface of new golf balls with a hammer to increase flight distance. The bramble ball, which was introduced around the turn of the twentieth century, was formed with bumps on the surface of the ball. Eventually, manufacturers began to manufacture golf balls having dimples formed in the outer surface.

The dimples on a golf ball are important in manipulating the aerodynamic forces generated by a ball in flight as a result of the ball's velocity and spin. These forces are lift and drag.

The lift force acts perpendicular to the direction of flight and is a result of air velocity differences above and below the rotating ball. Recognition of this phenomenon is attributed to Magnus and is described by Bernoulli's Equation. Bernoulli's Equation, which is a simplification of the first law of thermodynamics, relates pressure and velocity:

$$p + \frac{1}{2}\rho V^2 + \rho g h = c,$$

where p is the pressure, ρ is the density, V is the velocity, g is the gravitational acceleration, h is elevation, and c is a constant along a streamline. We see from Bernoulli's Equation that pressure is inversely proportional to the square of velocity. With respect to the flight of a golf ball, the velocity differential—faster moving air atop the ball and slower moving air beneath the ball—results in lower air pressure above the ball and an upward directed force on the ball.

The drag force acts opposite to the direction of flight and orthogonal to the lift force. The drag force on a golf ball is attributed to parasitic drag forces, which consist of form or pressure drag and viscous or skin friction drag. A sphere is a bluff body, an inefficient aerodynamic shape. Therefore, the accelerating flow field around the golf ball will separate from its outer surface, causing a large pressure differential with high pressure forward of the ball and low pressure rearward of the ball. This pressure differential results in the majority of the drag force on the ball. In order to minimize pressure drag, dimples are provided as a means to energize the flow field with turbulence and delay the separation of flow, thus reducing the low-pressure region behind the ball. However, the turbulent boundary layer increases skin friction, which is due directly to the shear stress on the ball. The reduction in pressure drag is far greater than the increase in skin friction drag, so the net result is a large reduction in total drag.

One method of positioning or packing dimples on a golf ball divides the surface of the golf ball into eight spherical triangles corresponding to the faces of an octahedron, which is a polyhedron having eight triangular faces. Dimples are then positioned within each of the surface divisions according to a placement scheme. The surface divisions may be further divided and the resulting subdivisions packed with dimples. Octahedron-based dimple patterns generally cover approximately 60–75% of the golf ball surface with dimples. Exemplary patents disclosing octahedron-based dimple patterns include U.S. Pat. Nos. 5,415,410 and 5,957,786, the disclosures of which are incorporated herein by reference.

Another dimple packing method divides the surface of the golf ball into 20 spherical triangles corresponding to the faces of an icosahedron, which is a polyhedron having twenty triangular plane faces. Dimples are then positioned within each of the surface divisions according to a placement scheme. The surface divisions may be further divided and the resulting subdivisions packed with dimples. Because most icosahedron-based dimple patterns incorporate a high degree of hexagonal packing (that is, each dimple is surrounded by six adjacent dimples), they typically achieve more than 75% dimple coverage. Exemplary patents disclosing icosahedron-based dimple patterns include U.S. Pat. Nos. 4,560,168 and 5,957,786, the disclosures of which are incorporated herein by reference.

Some known golf ball dimple patterns have contained overlapping dimples. For example, in the dimple pattern disclosed in the family of patents including U.S. Pat. No. 4,729,861, up to 45% of the dimple spacings may overlap. However, the design teaches to minimize the distance of overlap such that the overlap is no greater than about 0.02 inches. With the type of dimple pattern disclosed, it is typical that most overlaps will involve a maximum of only two neighboring dimples.

Another dimple pattern is disclosed in the family of patents including U.S. Pat. No. 4,877,252. In this dimple pattern, at least 10% of the dimples have overlap. However, the overlapping dimples overlap relatively few of their neighboring dimples, resulting in a low overlap saturation as that term is defined and used below.

These and other dimples patterns, of course, may be adjusted to accommodate a parting line, or for other reasons.

Another dimple pattern is disclosed in the family of patents including U.S. Pat. No. 5,273,287. In this dimple pattern, some of the dimples overlap in order to obtain a "substantial surface coverage" of dimples using one dimple size. However, overlap is undesired and is therefore kept to "some small percentage."

Another dimple pattern is disclosed in the family of patents including U.S. Pat. No. 5,356,150. In this dimple pattern, the dimples are elongated and have some amount of overlap. A similar dimple pattern to the same assignee is disclosed in the family of patents including U.S. Pat. No. 6,206,792. This dimple pattern also contains elongated dimples, but overlap is discouraged.

Another dimple pattern is disclosed in the family of patents including U.S. Pat. No. 5,688,194. This dimple pattern is generated automatically, starting with a random, overlapping layout of dimples. The dimple positions are then adjusted to avoid overlap.

Another dimple pattern is disclosed in the family of patents including U.S. Pat. No. 5,842,937. In this dimple pattern, dimple locations are defined using fractal geometry. Dimple overlap is contemplated, but no specifics are provided.

SUMMARY OF THE INVENTION

The present invention is directed to a dimpled body in which at least some of the dimples overlap adjacent dimples. A preferred body is a golf ball product. The golf ball product has an outer surface with dimples formed therein. At least some of the dimples overlap at least one adjacent dimple. The body has an overlap saturation from approximately 40% to approximately 100%. Overlap saturation is the ratio of the number of overlap instances on the ball to the maximum possible number for an ideal, hypothetical ball with the same number of dimples. In this context, the ideal dimple pattern is defined to have complete hexagonal packing of the dimples, meaning that every dimple on the ball has six adjacent dimples. Overlap instances are tallied by summing the number of overlapping adjacent dimples for every dimple. Thus, on the ideal ball, since every dimple has six overlapping adjacent dimples, the total number of overlap instances is equal to six times the number of dimples. The overlap saturation is preferably at least approximately 60%, and more preferably at least approximately 70%. The overlap saturation may preferably be limited such that it is less than approximately 85%.

Adjacent dimples may overlap at junctions, and at least some of the junctions preferably include ridges. These ridges provide sites in addition to the dimples for effective turbulence generation. The outer surface of the body also includes a land area. The land area may include a plurality of individual scalloped polygon areas.

The overlapping dimple patterns of the present invention result in an increase in total distance compared to an equivalent product without overlapping dimples. In terms of distance, the increase is from approximately 0.1 to approximately 2 yards, and more preferably from approximately 0.5 to approximately 1.3 yards. In terms of percentage, the increase is from approximately 0.1% to approximately 1%. The increase is inversely related to swing speed.

In another preferred embodiment, a majority of the dimples overlap at least one adjacent dimple. The majority preferably includes from approximately 60% to approximately 100% of the dimples. More preferably, the majority includes at least approximately 75% of the dimples, and still more preferably includes at least approximately 85% of the dimples.

In another preferred embodiment, the body has an outer surface with radially symmetric dimples formed therein. A majority of the dimples overlap a plurality of adjacent ones of the dimples. Preferably, a majority of the dimples overlap three, four, or more adjacent dimples. More preferably, a majority of the dimples overlap a majority of adjacent ones of the dimples.

Another aspect of the invention relates to a substantially seamless golf ball product. A substantially seamless surface is achieved while retaining a straight parting line that coincides with the ball's equator, as in a conventional ball with a seam. Dimples adjacent to the parting line are aligned and positioned to overlap across the parting line. Preferably, all of the dimples adjacent the parting line are aligned with and positioned to overlap corresponding dimples across said parting line. After buffing, the visual impact of the parting line is reduced, resulting in a substantially seamless golf ball product.

DESCRIPTION OF THE DRAWINGS

The present invention is described with reference to the accompanying drawings, in which like reference characters reference like elements, and wherein.

DETAILED DESCRIPTION OF THE INVENTION

Figure 1:
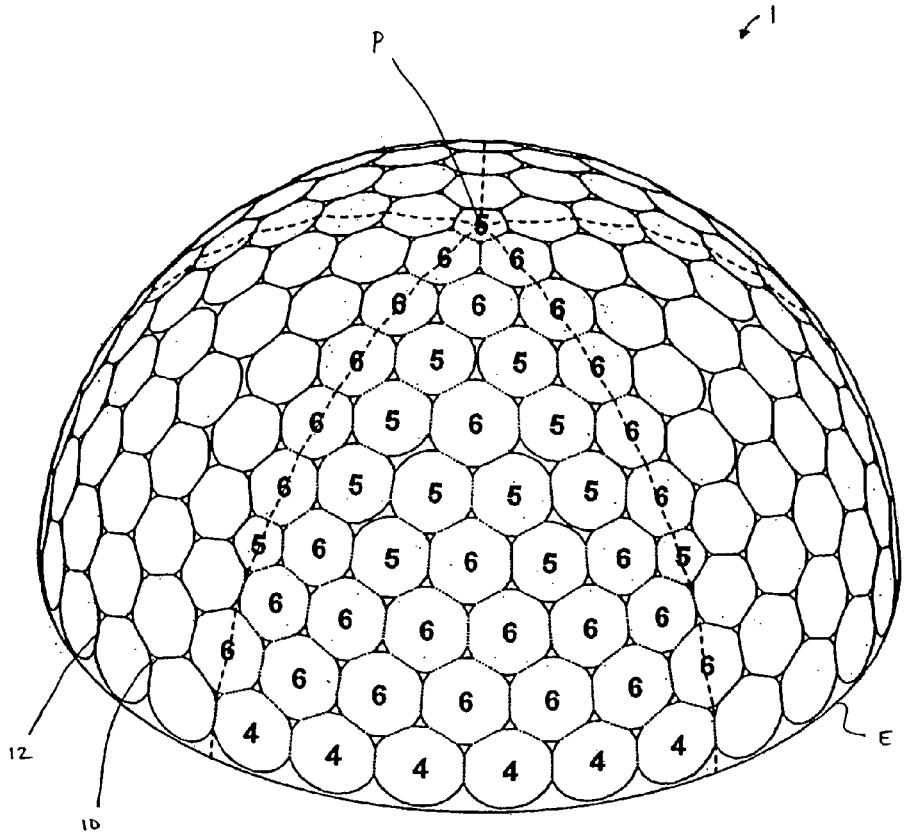
FIG. 1 shows a hemisphere of a first golf ball product of the present invention.

The present invention is directed to a non-streamlined body, such as a golf ball product, having dimples in the outer surface thereof. The dimples are arranged in a pattern such that at least some of the dimples overlap or intersect neighboring dimples. Preferably, a large portion of the dimples overlap adjacent dimples, and, preferably, a large portion of the dimples overlap most of their adjacent dimples. For the purposes of this patent, "golf ball product" is intended to mean a golf ball at any stage of development. This could be, for example, a core, a core with one or more mantle layers formed thereon, a core and a cover, a core with one or more mantle layers and a cover, etc.

As described above, golf balls have textured outer surfaces to improve their aerodynamic properties, especially the distance they will travel when struck with a golf club. The texture usually comprises an arrangement of dimples covering the surface. While dimples typically have a circular shape, they may also be polygonal, oval, elliptical, egg-shaped, or another shape or combination of shapes. Traditionally, these dimples are arranged to substantially cover the ball's surface with little or no overlap.

The dimple patterns of the present invention feature high degrees of overlap among adjacent dimples, which can provide aerodynamic advantages over conventional layouts that have fewer overlap instances or none at all. The present invention is defined in terms of a new parameter called Overlap Saturation (OS). OS is the ratio of the number of overlap instances on the ball to the maximum possible number for an ideal, hypothetical ball with the same number of dimples. In this context, the ideal dimple pattern is defined to have complete hexagonal packing of the dimples, meaning that every dimple on the ball has six adjacent dimples. Overlap instances are tallied by summing the number of overlapping adjacent dimples for every dimple. Thus, on the ideal ball, since every dimple has six overlapping adjacent dimples, the total number of overlap instances is equal to six times the number of dimples.

The golf ball products of the present invention preferably have an OS from approximately 40% to approximately 100%. More preferably, the golf ball products of the present invention have an OS from approximately 60% to approximately 85%. Additional preferred OS ranges include at least approximately 60% and at least approximately 70%. In a preferred embodiment, approximately 60% to approximately 100% of the dimples overlap at least one adjacent dimple. More preferably, at least approximately 70% of the dimples overlap at least one adjacent dimple, and still more preferably at least approximately 75% of the dimples overlap at least one adjacent dimple. In a preferred embodiment, a majority of the dimples overlap three or more adjacent dimples, and more preferably four or more adjacent dimples. In another preferred embodiment, a majority of the dimples overlap a majority of adjacent ones of the dimples.

Increased OS results in a higher percentage of dimple coverage for the golf ball products of the present invention than with related conventional dimple patterns. A preferred range of dimple coverage includes approximately 80% to approximately 98% of the outer surface of the golf ball product. For example, known octahedron-based dimple patterns generally cover approximately 60–75% of the golf ball surface with dimples. However, using an overlapping dimple pattern of the present invention, one may achieve substantially increased percentages. Exemplary embodiments of the high-OS octahedron-based patterns achieved greater than 80% coverage and greater than 85% coverage, respectively. Similarly, known icosahedron-based dimple patterns typically achieve approximately 75%–80% dimple coverage. Exemplary embodiments of the high-OS icosahedron-based patterns achieved greater than 85% coverage and greater than 90% coverage, respectively.

Note that overlapping dimples may require an altered method of calculating the percentage of the surface that is dimpled. Typically, the percentage of the surface area covered by each dimple size is calculated and multiplied by the number of occurrences of that dimple size on the ball. The values for each dimple size are then summed, and the resulting figure is divided by the total surface area of the golf ball product. Here, however, since the dimples overlap, this method of calculating percentage surface coverage will likely yield inaccurate results. An alternate method entails calculating the non-dimpled area of the total surface area, subtracting this figure from the total surface area, and dividing this resulting figure by the total surface area to calculate the percentage coverage.

FIG. 1 shows a hemisphere of a first golf ball product 1 of the present invention. Golf ball product 1 has 392 dimples arranged in an icosahedron pattern. Only one hemisphere is shown for simplicity (the other hemisphere is identical), and that hemisphere comprises five identical sections as delineated by the dashed lines radiating from the pole P. The boundaries between dimples where overlapping occurs are shown as dotted lines. At least some of the dimples overlap at least one adjacent dimple. The numbers superimposed on the dimples designate the number of overlap instances for that dimple. The ideal maximum number of overlap instances for a ball having 392 dimples is 2, 352 (392·6). A tally of golf ball product 1 yields 2, 120 overlap instances. Thus, golf ball product 1 has an OS of 90.1% (2, 120/2, 352).

Figure 2:
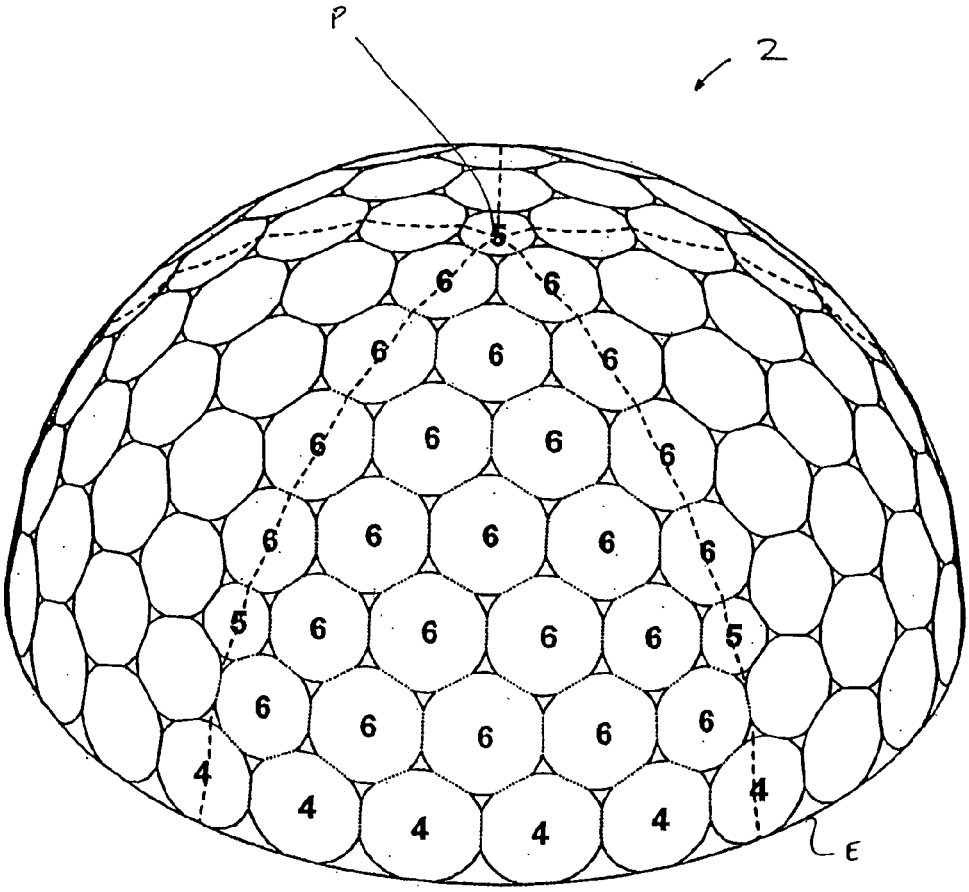
FIG. 2 shows a hemisphere of a second golf ball product of the present invention.

FIG. 2 shows a hemisphere of a second golf ball product 2 of the present invention. Golf ball product 2 has 252 dimples arranged based on an icosahedron pattern. Similarly to FIG. 1, the illustrated hemisphere of FIG. 2 comprises five identical sections as delineated by the dashed lines radiating from the pole P. The boundaries between dimples where overlapping occurs are shown as dotted lines. The numbers superimposed on the dimples designate the number of overlap instances for that dimple. Golf ball product 2 has 1,400 overlap instances, yielding an OS of 92.6%.

Figure 3:
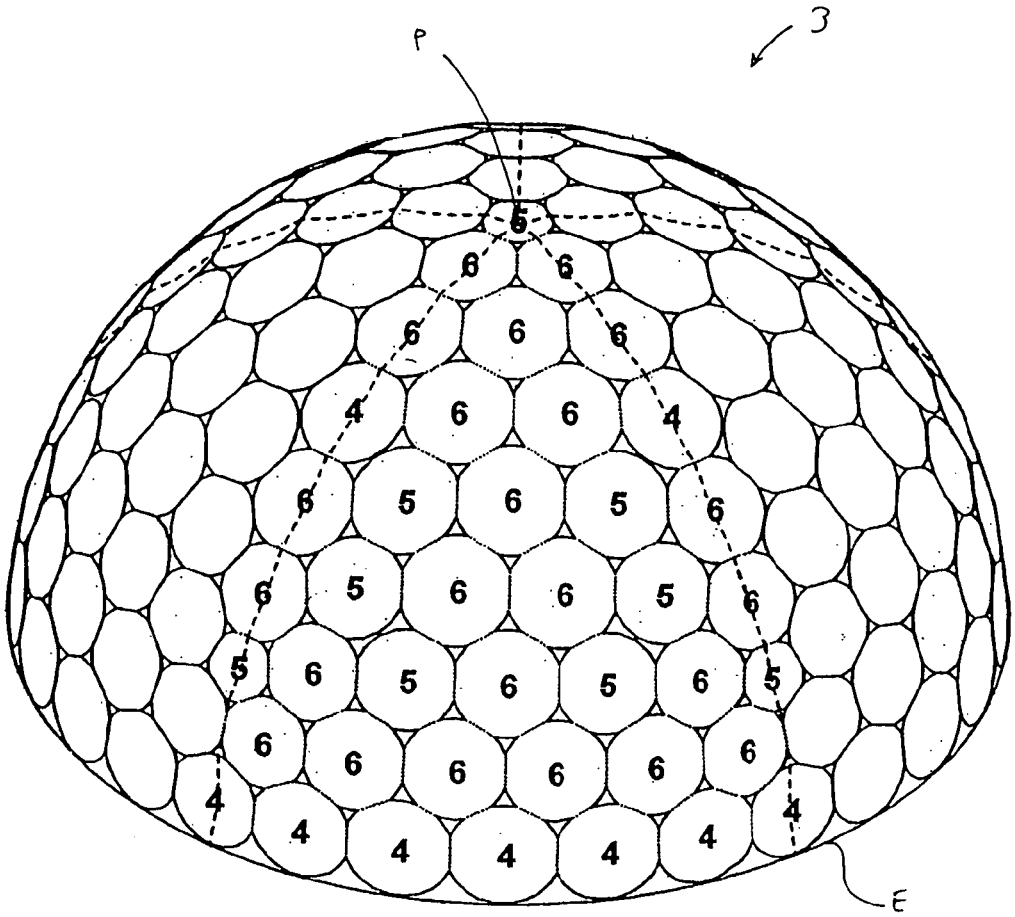
FIG. 3 shows a hemisphere of a third golf ball product of the present invention.

FIG. 3 shows a hemisphere of a third golf ball product 3 of the present invention. Golf ball product 3 has 332 dimples arranged in an icosahedron pattern. Overlapping dimple boundaries are shown as dotted lines, and the superimposed numbers designate the number of overlap instances for each dimple. There are 1, 780 overlap instances in golf ball product 3, providing an OS of 89.4%.

Figure 4:
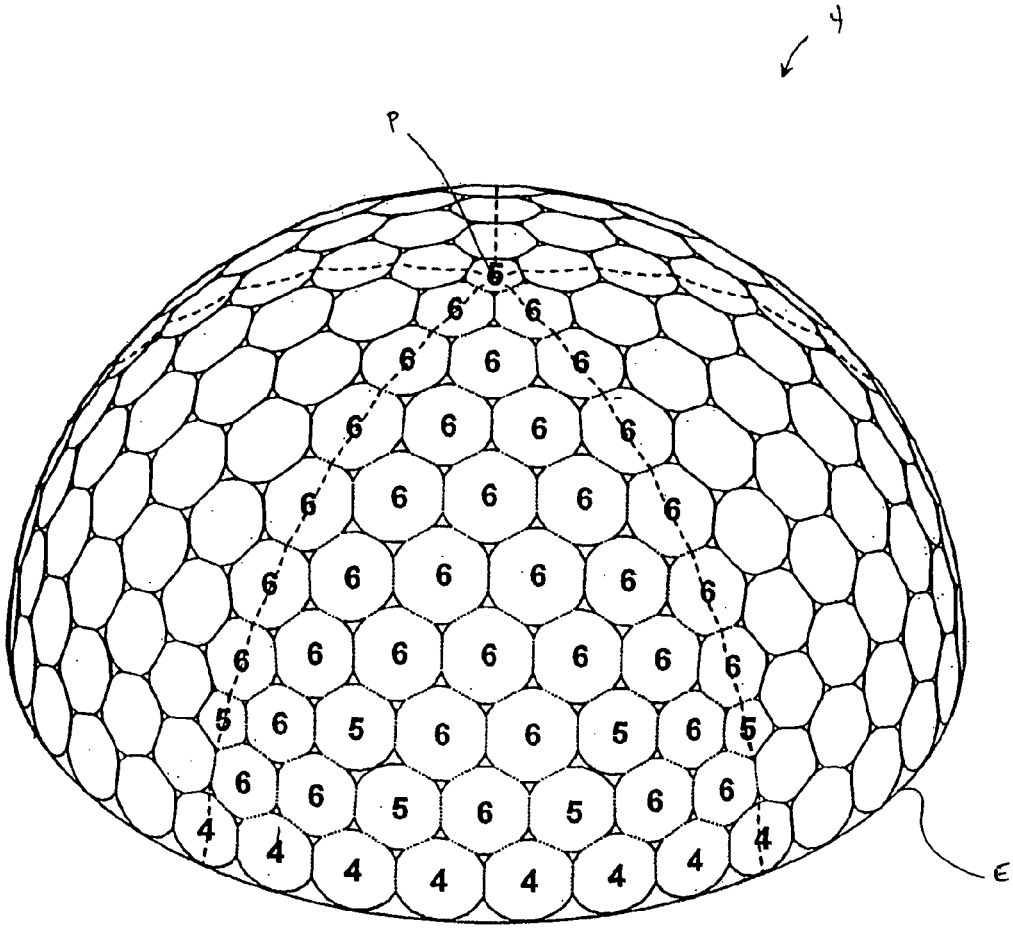
FIG. 4 shows a hemisphere of a fourth golf ball product of the present invention.

FIG. 4 shows a hemisphere of a fourth golf ball product 4 of the present invention. Golf ball product 4 has 422 dimples arranged in an icosahedron pattern. Overlapping dimple boundaries are shown as dotted lines, and the superimposed numbers designate the number of overlap instances for each dimple. There are 2, 340 overlap instances in golf ball product 4, providing an OS of 92.4%.

Figure 5:
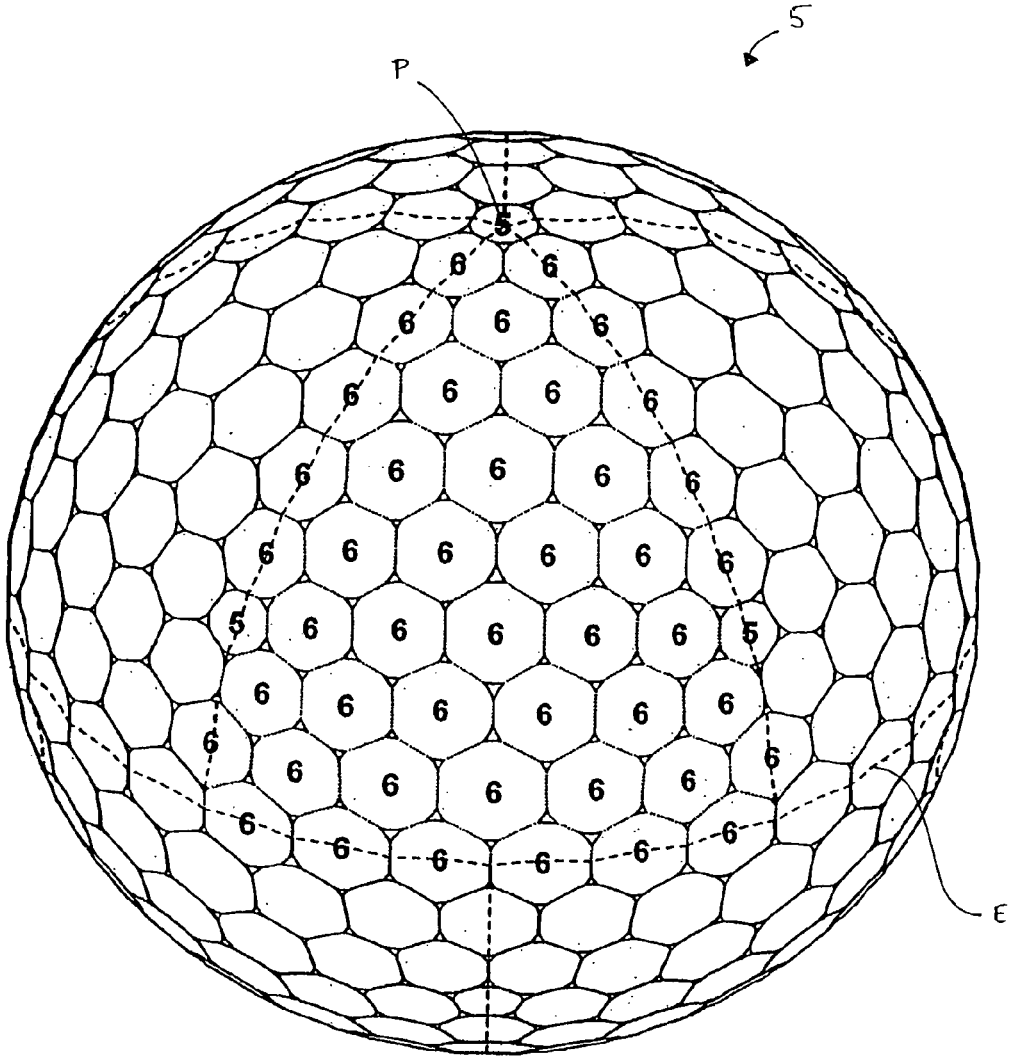
FIG. 5 shows a fifth golf ball product of the present invention.

The OS values of golf ball products 1–4 are in the neighborhood of 90%. Although these numbers are quite high, they could be higher if the dimple patterns were not interrupted by the presence of a great circle parting line, not intersecting any dimples, at the equator E of the ball. FIG. 5 shows a fifth golf ball product 5 of the present invention in which there are 362 dimples arranged with no such great circle parting line. Since every dimple overlaps each of its adjacent dimples, and nearly all of the dimples have six adjacent dimples, there are 2, 160 overlap instances providing a very high OS value of 99.4%.

Figure 6:
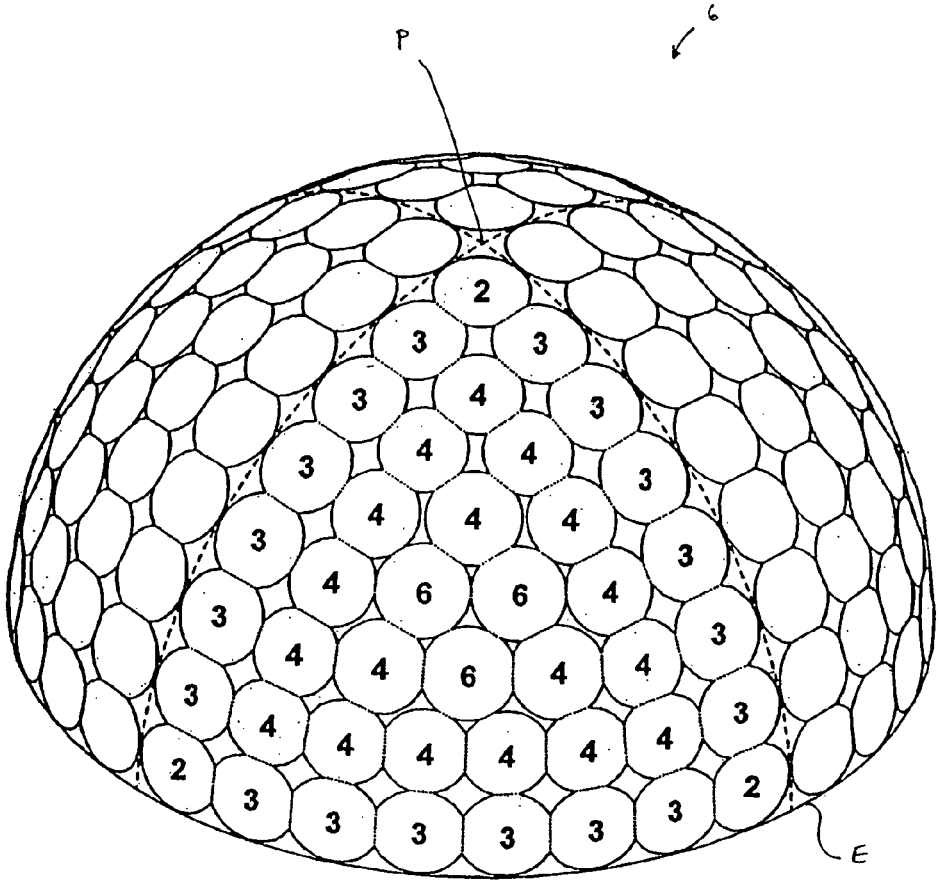
FIG. 6 shows a hemisphere of a sixth golf ball product of the present invention.

Golf ball products 1–5 have icosahedron-based dimple patterns, which are particularly suitable for achieving high OS values due to the high degree of hexagonal packing that is characteristic of this type of layout. This brings them close to the ideal dimple pattern in which each dimple has six neighboring dimples. However, it is still possible to achieve relatively high values of OS with other types of dimple patterns. A hemisphere of a sixth golf ball product 6 of the present invention is shown in FIG. 6. Golf ball product 6 has an octahedron-based dimple pattern with 336 dimples. The numbers superimposed on the dimples designate the number of overlap instances for that dimple. There are 1,200 overlap instances, providing golf ball product 6 with an OS of 59.5%. Although lower than the previous examples, it is still substantially greater than what can be found in known golf balls.

Figure 7:
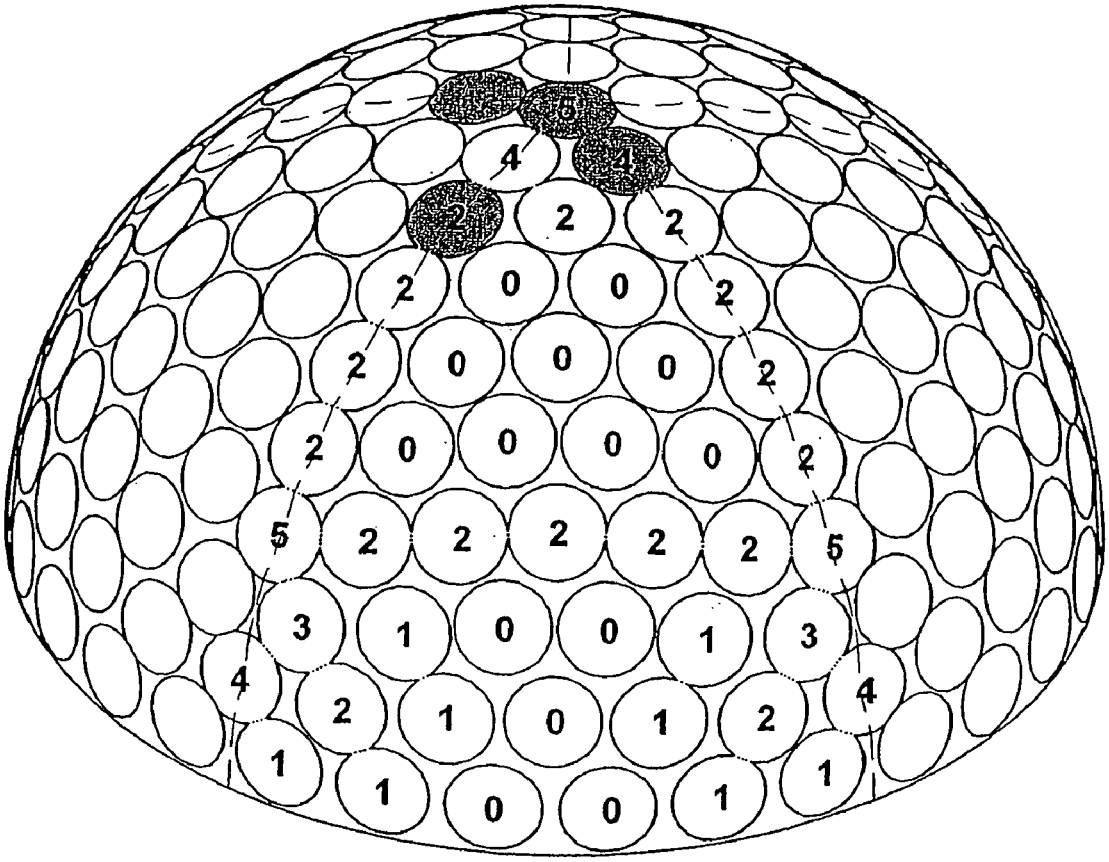
FIGURE 7 PRIOR ART
FIGS. 7 & 8 show known golf balls with dimple patterns having some amount of overlap.
Figure 8:
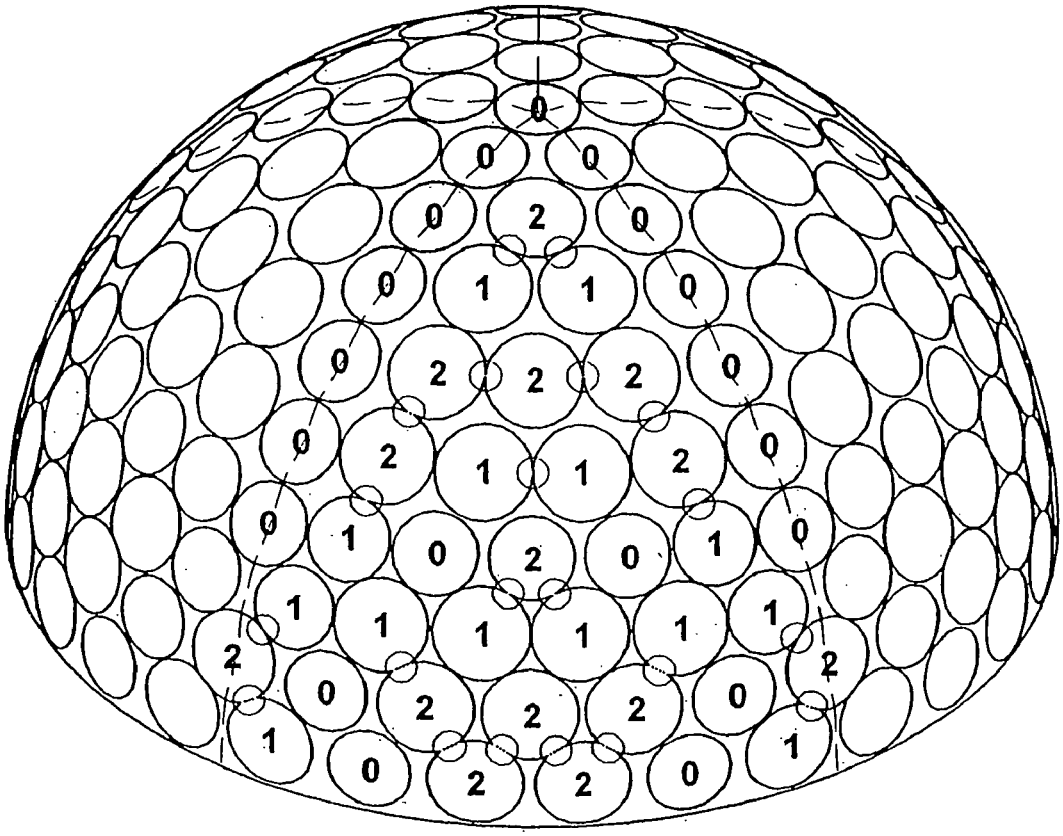
FIGURE 8 PRIOR ART

For example, FIGS. 7 & 8 show known golf balls with dimple patterns having some amount of overlap. The numbers superimposed on the dimples designate the number of overlap instances for that dimple. FIG. 7 shows a hemisphere of the Titleist® 384DT® golf ball. The shaded dimples were deleted from the layout to provide a nameplate stamping area. This ball has an OS of 21.3%. FIG. 8 shows a Titleist® Professional golf ball. The overlap instances are circled for clarity, since some of them are slight. This ball has an OS of 17.0%.

Figure 9:
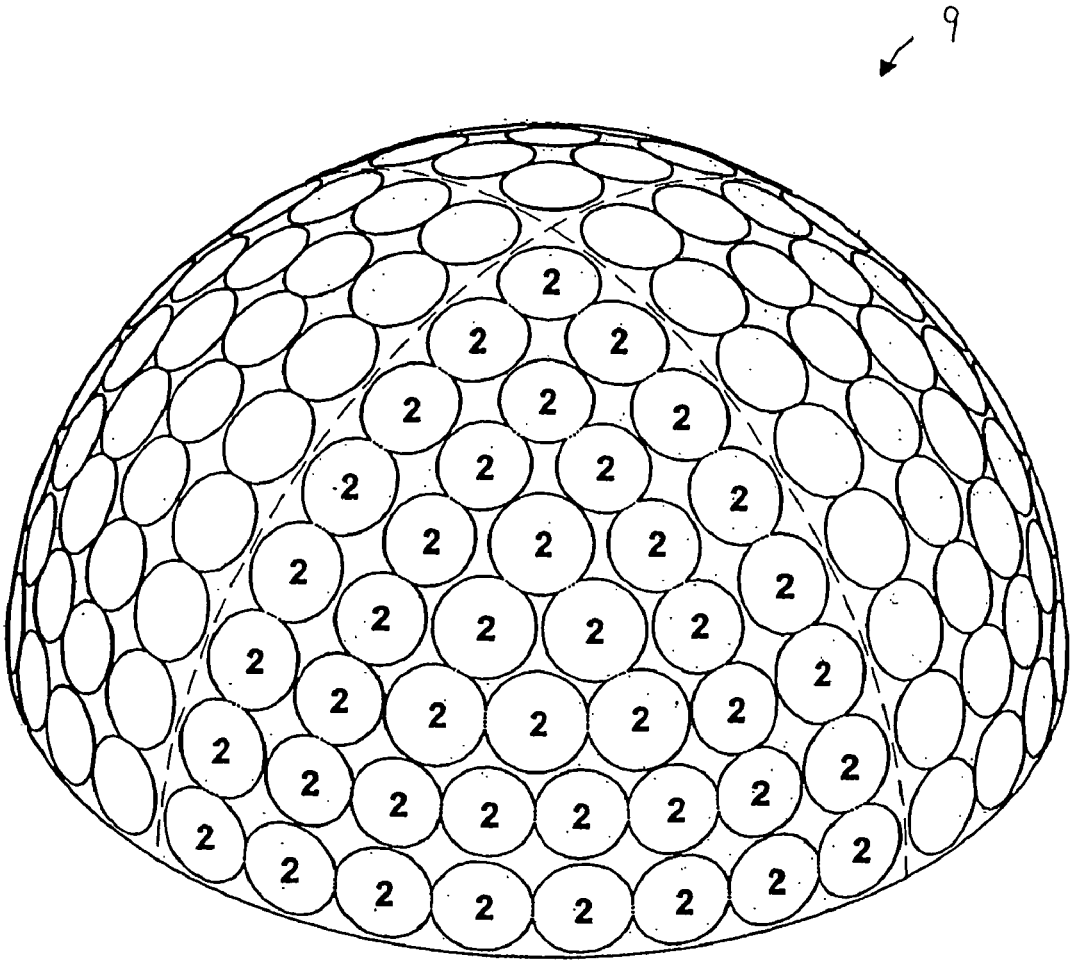
FIG. 9 shows an exemplary golf ball product in which all of the dimples overlap adjacent dimples.

Having a high percentage of dimples that overlap adjacent dimples does not necessarily yield a high OS. FIG. 9 shows an exemplary golf ball product 9 in which all of the dimples overlap adjacent dimples. The numbers superimposed on the dimples designate the number of overlap instances for that dimple. Although 100% of the dimples have overlap, golf ball product 9 has an OS of only 33.3%. Similarly, the golf balls shown in FIGS. 1–2 and 3–4 of U.S. Pat. No. 4,877,252, discussed above, have OS values of only 26.0% and 27.8%, respectively.

To test the aerodynamic performance of the overlap dimple patterns of the present invention, several prototypes were constructed having 392 dimples and varying OS values. The various overlapping dimple patterns were obtained by starting with a no overlap pattern (OS=0) and increasing all of the dimple diameters in 0.005" increments without altering the dimple locations. This created dimple patterns having OS values ranging up to 90.1% as shown in FIG. 1. The aerodynamic lift and drag coefficients of these prototypes were then measured over a range of Reynolds Number and spin rate combinations sufficient to cover the conditions encountered during a normal golf ball driver trajectory. These measurements were made using a facility known as an Indoor Test Range (ITR), as described in U.S. Pat. Nos. 5,682,230 and 6,186,002, the disclosures of which are incorporated herein by reference. Total driver distances were then calculated in accordance with the teachings of the '002 patent, using launch conditions representative of novice, average, and skilled golfers.

Figure 10:
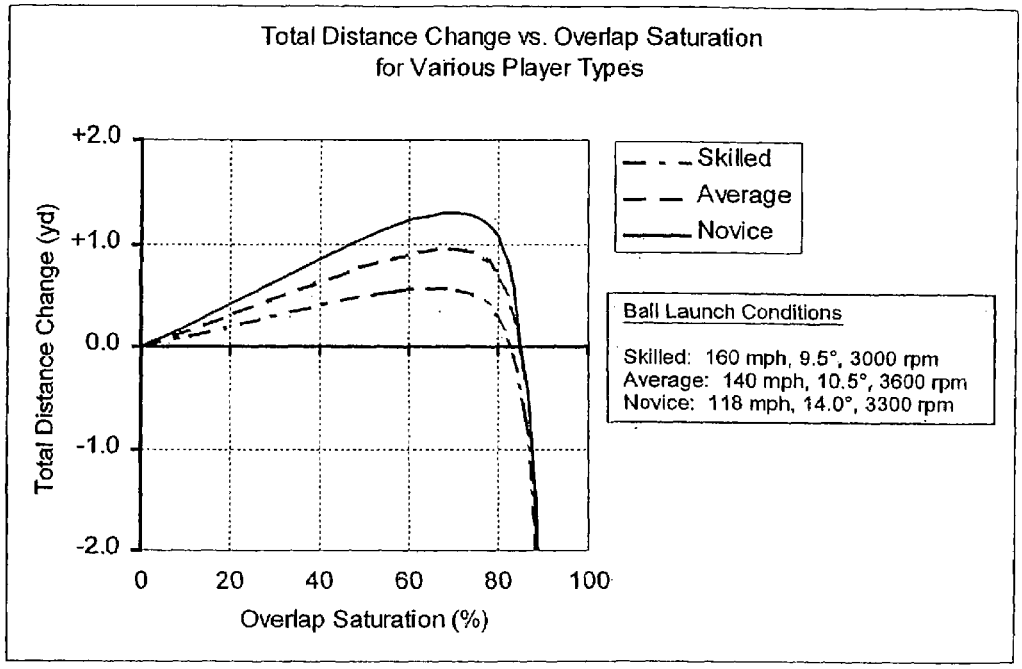
FIG. 10 is a chart illustrating the effect of overlap saturation on the change in total distance.

FIG. 10 presents the results of this experiment, showing the effect of Overlap Saturation. The chart of FIG. 10 is a comparison between a golf ball product having a dimple pattern of the present invention to an equivalent product without overlapping dimples. That is, golf ball products of the present invention were compared to golf ball products having the same dimple number and locations, but having OS=0, as described above. The change in total distance (total distance at a given OS value minus the total distance at OS=0) is plotted for the novice, average, and skilled golfers. It is seen that increasing OS has a consistently positive effect on total distance, up to an OS value of about 85%. The maximum benefit occurs at about 70%. The increase in total distance is inversely related to swing speed. That is, the increase in total distance increases with decreasing swing speed as we move from the skilled to the average to the novice player. Thus, the lower swing speed players derive the greatest benefit, which would also be seen by faster swingers when using clubs shorter than the driver. As shown in FIG. 10, the average increase in total distance is from approximately 0.1 yard to approximately 2 yards, and more preferably from approximately 0.5 yard to approximately 1.3 yards. In terms of percentage, the average increase in total distance is from approximately 0.1% to approximately 1%.

The dimple patterns of the present invention feature high degrees of overlap among adjacent dimples, which can provide aerodynamic advantages over conventional layouts that have fewer overlap instances or none at all. One reason is the effect of the overlapped dimples on the land area 10. The golf ball products of the present invention have a great degree of overlap. The overlap results in a reduction in frontal area (or silhouette), since many locations that would have been land area between the dimples are now cut down slightly below the spherical surface. This reduced frontal area acts to reduce the drag force acting on the ball during flight, resulting in greater flight distances. Furthermore, the remaining land areas take on the form of individual scalloped polygons rather than a continuous surface. (The land area around the equator E may be contiguous.) These scalloped polygons should serve as effective turbulence generators, akin to brambles or other protrusions. The scalloped polygons may be even more effective than conventional non-overlapping dimples at lower speeds. The junction lines 12 between overlapping dimples become sharp ridges, providing additional sites for effective turbulence generation.

Golf balls are typically made using two mold halves that cooperate to form a molding cavity. The formed golf ball product includes a parting line corresponding to the junction of the mold halves. The parting line for the cover is usually located at the ball's equator. As a result of the molding process, there is typically a buildup of flash along the parting line. The flash is removed by buffing the parting line. Dimples are usually spaced away from the parting line so that they are not disturbed during buffing. However, this results in an undimpled area that can adversely affect the aesthetic appearance and aerodynamic performance of the golf ball.

The cosmetic or aesthetic appearance of a golf ball is improved by producing a seamless golf ball. The aerodynamic performance is also enhanced, since any orientation-related variations are reduced. These benefits are realized because the spatial relationships and configurations of the dimples near the parting line are more similar to those on other parts of the ball. The parting line, thus, presents less of a visual disruption and less of an aerodynamic disruption to the dimple pattern.

Prior attempts to produce seamless golf balls have required corrugated mold parting lines that traverse back and forth to opposite sides of the equator. A seamless appearance is achieved by positioning certain dimples to intersect the equator of the ball, lying partially in both hemispheres. In order to avoid leaving molding flash inside the periphery of these dimples, where it is very difficult to remove, the parting line is routed around them in a serpentine or step fashion. This creates a complex three-dimensional parting surface between the mold halves that is difficult to machine with sufficient accuracy.

The present invention achieves a seamless design while retaining a straight parting line that coincides with the ball's equator, as in a conventional ball with a seam. Accordingly, the parting surface separating the mold halves is a simple plane, which is easy to machine with great accuracy.

Figure 11:
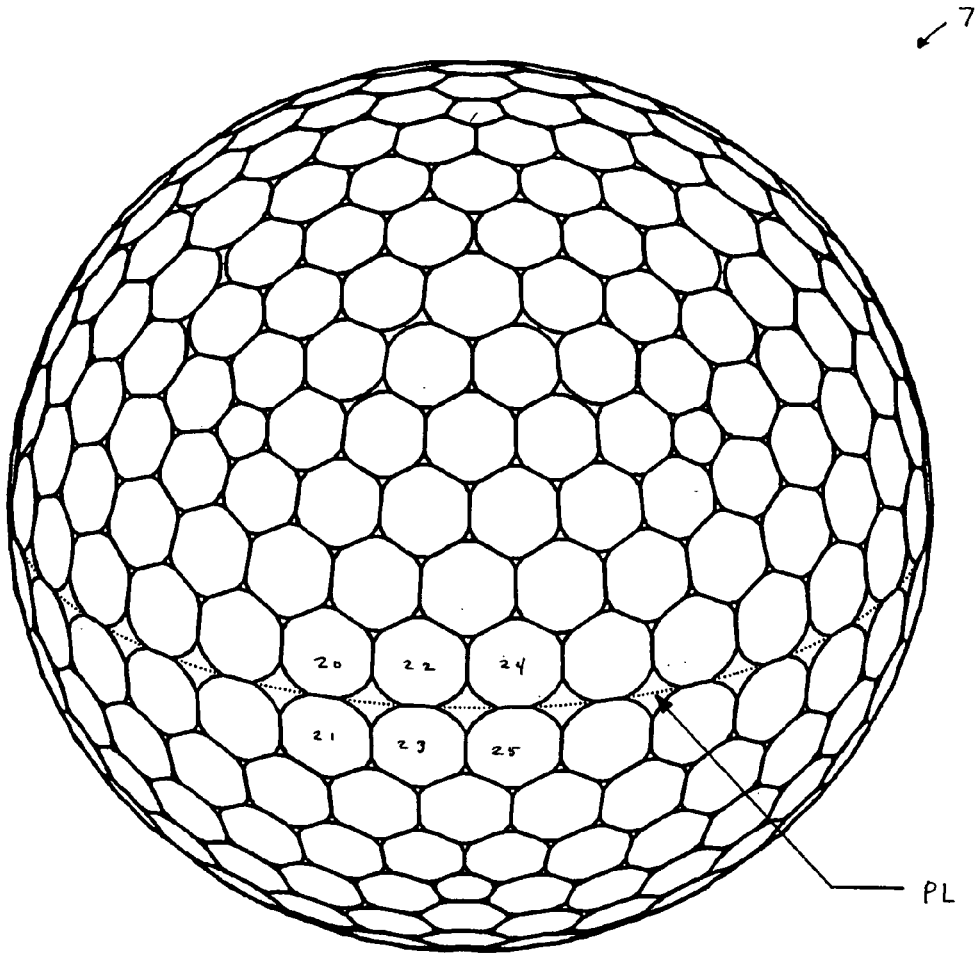
FIG. 11 shows a seventh golf ball product of the present invention.

FIG. 11 shows a seventh golf ball product 7 of the present invention. Golf ball product 7 has 392 dimples arranged based on an icosahedron pattern. The parting line PL of golf ball product 7 is equatorial and is shown as a dotted line. Dimples adjacent to parting line PL are aligned and positioned to overlap across parting line PL. For example, dimple 20 is aligned and positioned to overlap dimple 21, dimple 22 is aligned and positioned to overlap dimple 23, dimple 24 is aligned and positioned to overlap dimple 25, etc. Preferably, all of the dimples adjacent parting line PL are aligned with and positioned to overlap corresponding dimples across said parting line. After buffing, the visual impact of parting line PL is reduced, resulting in a substantially seamless golf ball product. For the purposes of this patent, "substantially seamless" is intended to mean that the seam is substantially indiscernible or hidden, such that it is covered by dimples much like the rest of the ball surface. Only land areas 10 need to be buffed, since the remaining portions of parting line PL coincide with dimple junctions. These junctions may include ridges, the benefits of which are provided above.

Figure 12:
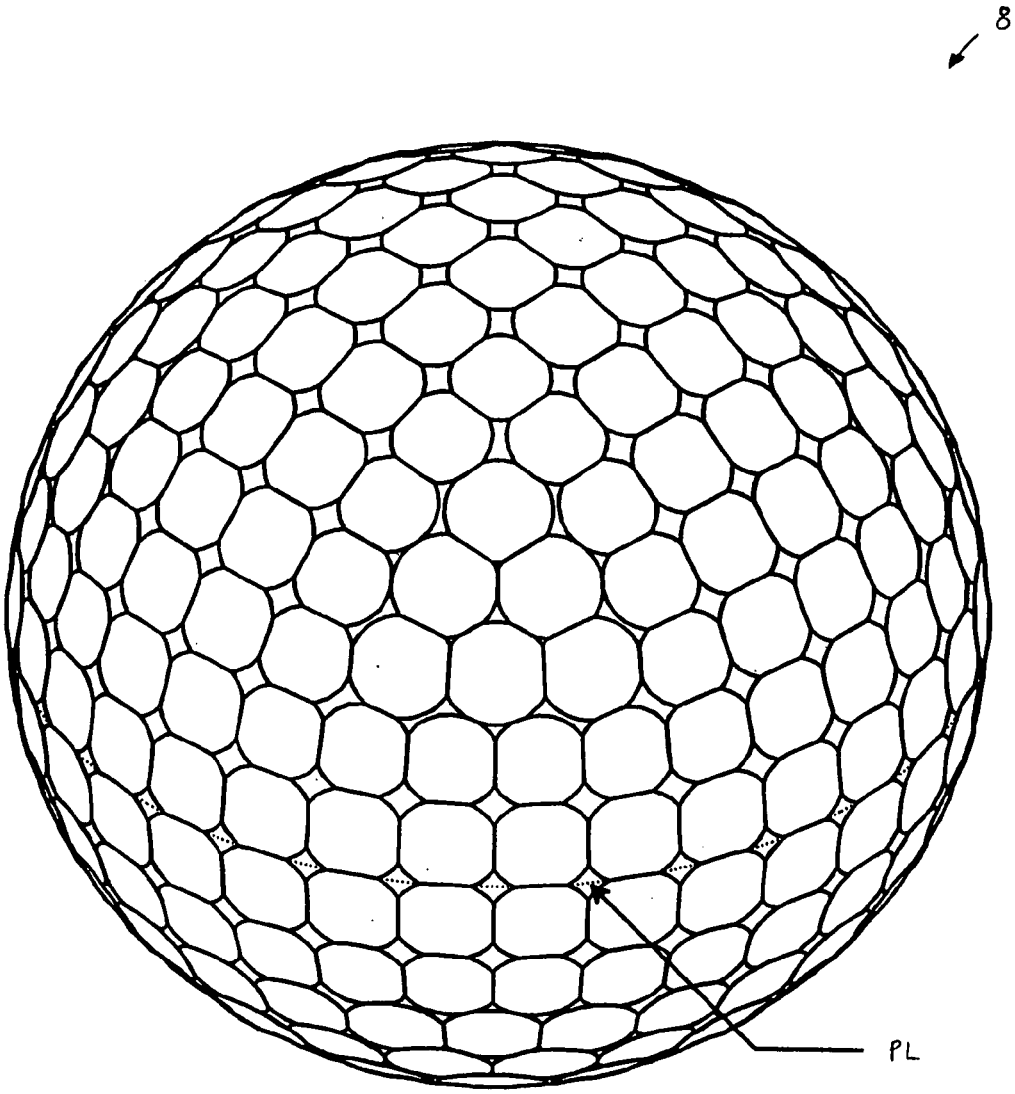
FIG. 12 shows an eighth golf ball product of the present invention.
Figure 13:
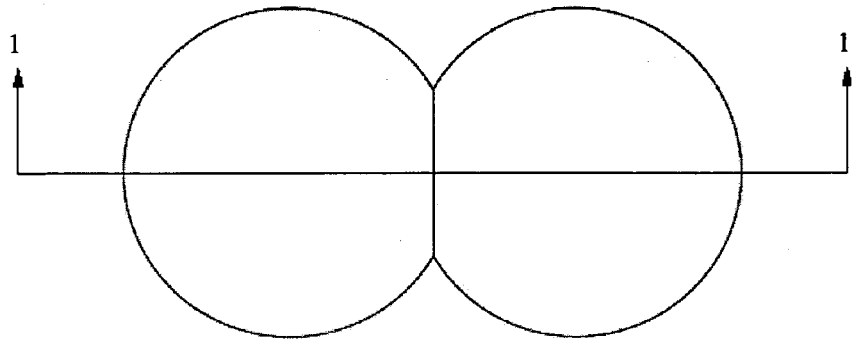
FIG. 13 shows two exemplary overlapping dimples.
Figure 14:
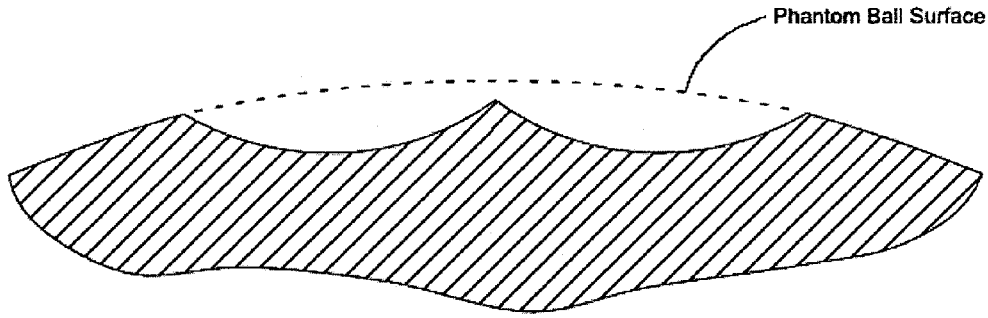
FIG. 14 shows a view through the overlapping dimples of FIG. 13 along line 1—1.

The seamless appearance is increased with predominantly square packing, as in eighth golf ball product 8 shown in FIG. 12. Golf ball product 8 has 336 dimples arranged in an octahedron-based pattern. In this type of dimple pattern, the dimples (or a large percentage of the dimples) have four neighboring dimples. Similarly to golf ball product 7, golf ball product 8 has dimples aligned across equatorial parting line PL that are positioned to overlap across said parting line. Golf ball product 8 has a substantially seamless appearance and, as illustrated in FIG. 12, parting line PL has substantially disappeared.

Although the preferred dimple is circular when viewed from above, the dimples may be triangular, square, pentagonal, hexagonal, heptagonal, octagonal, etc. In addition to these radial symmetric shapes, the dimples may also have irregular shapes, such as ovals or ellipses. Possible cross-sectional shapes include, but are not limited to, circular arc, truncated cone, flattened trapezoid, and profiles defined by a parabolic curve, ellipse, semi-spherical curve, saucer-shaped curve, sine curve, or the shape generated by revolving a catenary curve about its symmetrical axis. For additional discussion on dimple shape, see U.S. patent application Ser. No. 09/989,191, filed on Nov. 21, 2001, the disclosure of which is incorporated herein in its entirety. Other possible dimple designs include dimples within dimples and constant depth dimples. In addition, more than one shape or type of dimple may be used on a single ball, if desired.

When the term diameter is used herein, it is defined as the distance from edge to edge when the dimple is circular. When the dimple is non-circular, the term diameter is defined as the diameter of a circle having the same area as the non-circular dimple. When the term depth is used herein, it is defined as the distance from the continuation of the periphery line to the deepest part of a dimple.

The dimple patterns of the present invention can be used with any type of golf ball with any playing characteristics. For example, the dimple pattern can be used with conventional golf balls, solid or wound. These balls typically have at least one core layer and at least one cover layer. Wound balls typically have a spherical solid rubber or liquid filled center with a tensioned elastomeric thread wound thereon. Wound balls typically travel a shorter distance, however, when struck as compared to a two piece ball. The cores of solid balls are generally formed of a polybutadiene composition. In addition to one-piece cores, solid cores can also contain a number of layers, such as in a dual core golf ball. Covers, for solid or wound balls, are generally formed of ionomer resins, balata, or polyurethane, and can consist of a single layer or include a plurality of layers and, optionally, at least one intermediate layer disposed about the core.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while the invention above has been described with respect to golf balls, the teachings could be applied to other non-streamlined bodies that move through a fluid medium. Thus the present invention should not be limited by the above-described exemplary embodiments, but should be defined only in accordance with the following claims and their equivalents.

What is claimed is:

1. A golf ball product, comprising:

an outer surface having dimples formed therein; and a parting line;

wherein some of said dimples are aligned across said parting line and positioned to overlap across said parting line; and wherein the golf ball product has an overlap saturation from approximately 40% to approximately 100%.

2. The golf ball product of claim 1, wherein said parting line is equatorial.

3. The golf ball product of claim 1, wherein all of said dimples adjacent said parting line are aligned with and positioned to overlap corresponding dimples across said parting line.

4. The golf ball product of claim 1, wherein a majority of said dimples overlap a plurality of adjacent ones of said dimples.

5. The golf ball product of claim 4, wherein a majority of said dimples overlap three or more adjacent dimples.

6. The golf ball product of claim 5, wherein a majority of said dimples overlap four or more adjacent dimples.

7. The golf ball product of claim 4, wherein a majority of said dimples overlap a majority of adjacent ones of said dimples.

* * * * *